US011120755B2

(12) United States Patent
Kang

(10) Patent No.: US 11,120,755 B2
(45) Date of Patent: Sep. 14, 2021

(54) DRIVING METHOD AND DRIVING DEVICE FOR DISPLAY PANEL TO IMPROVE COLOR SHIFT WITHOUT AFFECTING DISPLAY PANEL TRANSMITTANCE AND DISPLAY APPARATUS

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chihtsung Kang, Shenzhen (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/041,676

(22) PCT Filed: Feb. 26, 2019

(86) PCT No.: PCT/CN2019/076177
§ 371 (c)(1),
(2) Date: Sep. 25, 2020

(87) PCT Pub. No.: WO2020/155257
PCT Pub. Date: Aug. 6, 2020

(65) Prior Publication Data

US 2021/0012730 A1 Jan. 14, 2021

(30) Foreign Application Priority Data

Jan. 30, 2019 (CN) ..... 201910096420.7

(51) Int. Cl.
*G09G 3/36* (2006.01)

(52) U.S. Cl.
CPC ..... *G09G 3/3607* (2013.01); *G09G 3/3677* (2013.01); *G09G 3/3688* (2013.01);
(Continued)

(58) Field of Classification Search
CPC ..... G09G 3/36; G09G 3/3607; G09G 3/3611; G09G 3/3614; G09G 3/3622;
(Continued)

(56) References Cited

U.S. PATENT DOCUMENTS 7,176,868 B2 2/2007 Kudo et al.
10,796,651 B2 * 10/2020 Kang ..... G09G 3/3614
(Continued)

FOREIGN PATENT DOCUMENTS

CN 101676985 A 3/2010
CN 102768817 A 11/2012
(Continued)

OTHER PUBLICATIONS

First Office Action in counterpart Chinese Patent Application No. 201910096420.7, dated Jan. 15, 2020.
(Continued)

*Primary Examiner* — Alexander Eisen
*Assistant Examiner* — Nelson Lam
(74) *Attorney, Agent, or Firm* — Westbridge IP LLC

(57) ABSTRACT

Disclosed are a driving method, a driving device and a driving device of a display panel. The method comprises the following steps of: performing positive driving on a first adjacent sub-pixel of the two adjacent sub-pixels in a second direction in a first time interval, and performing negative driving on a second adjacent sub-pixel of the two adjacent sub-pixels in a second direction in a second time interval, wherein the duration of the first time interval is different from that of the second time interval. Obviously, due to the difference between the positive driving duration and the
(Continued)

negative driving duration, the charging ability is different, forming a high-low voltage pixel unit interspersed arrangement, thus improving the color shift.

9 Claims, 10 Drawing Sheets

(52) U.S. Cl.
CPC ... *G09G 3/3696* (2013.01); *G09G 2300/0452* (2013.01); *G09G 2320/0242* (2013.01)

(58) Field of Classification Search
CPC .... G09G 3/3625; G09G 3/364; G09G 3/3644; G09G 3/3677; G09G 3/3681; G09G 3/3688; G09G 3/3692; G09G 3/3698; G09G 2300/0452
USPC ..... 345/87–104
See application file for complete search history.

(56) References Cited

U.S. PATENT DOCUMENTS

| | | | | |
|---|---|---|---|---|
| 10,930,235 | B2 * | 2/2021 | Kang | G09G 3/3607 |
| 2011/0298778 | A1 * | 12/2011 | Chiang | G09G 3/3648 345/212 |
| 2012/0013657 | A1 * | 1/2012 | Tang | G09G 3/3607 345/694 |
| 2013/0113770 | A1 * | 5/2013 | Kang | G09G 3/3614 345/209 |
| 2015/0170598 | A1 * | 6/2015 | Jeon | G09G 3/3611 345/96 |
| 2015/0179127 | A1 * | 6/2015 | Lin | G09G 3/3614 345/96 |
| 2016/0253946 | A1 * | 9/2016 | Park | G09G 3/36 345/694 |
| 2017/0169776 | A1 * | 6/2017 | Hwang | G09G 3/3614 |
| 2019/0189065 | A1 * | 6/2019 | Wu | G09G 3/3607 |
| 2020/0090605 | A1 * | 3/2020 | Kang | G09G 3/3674 |
| 2021/0020130 | A1 * | 1/2021 | Shan | G09G 3/3677 |

FOREIGN PATENT DOCUMENTS

| | | | |
|---|---|---|---|
| CN | 106486077 | A | 3/2017 |
| CN | 107045858 | A | 8/2017 |
| CN | 108831405 | A | 11/2018 |
| CN | 109192168 | A | 1/2019 |
| JP | 2008216893 | A | 9/2008 |

OTHER PUBLICATIONS

International Search Report and Written Opinion in corresponding PCT Application No. PCT/CN2019/076177, dated Oct. 8, 2019.
Second Office Action in counterpart Chinese Patent Application No. 201910096420.7, dated May 13, 2020.
Third Office Action in counterpart Chinese Patent Application No. 201910096420.7, dated Nov. 17, 2020.

* cited by examiner

DRIVING METHOD AND DRIVING DEVICE FOR DISPLAY PANEL TO IMPROVE COLOR SHIFT WITHOUT AFFECTING DISPLAY PANEL TRANSMITTANCE AND DISPLAY APPARATUS

CROSS REFERENCE TO RELATED APPLICATIONS

The present application is the National Stage of International Application No. PCT/CN2019/076177, filed on Feb. 26, 2019, which claims the benefit of Chinese patent application filed in the National Intellectual Property Administration on Jan. 30, 2019, with the application No. 201910096420.7 and title "Driving method and device of display panel, and display apparatus", the entire contents of which are hereby incorporated by reference.

TECHNICAL FIELD

The present application relates to the technical field of liquid crystal display, in particular to a driving method and device of a display panel, and a display apparatus.

BACKGROUND

Most current large-size liquid crystal display panels are made from vertical alignment (VA) liquid crystals or In-Plane Switching (IPS) liquid crystals.

Comparing VA liquid crystal technology with IPS liquid crystal technology, it can be found that VA liquid crystal technology has a higher production efficiency and a lower manufacturing cost, but it is inferior to IPS liquid crystal technology on optical properties and has obvious defects on optical properties.

Especially when applied to large-sized display panels, see FIG. 1. If the display panel is viewed in a small viewing angle when the VA liquid crystal is driven, for example, in a front view, brightness of pixel will change linearly with voltage, see the ideal curve in FIG. 1. If the display panel is viewed in a large viewing angle, the brightness of the pixel will quickly saturate with the voltage, resulting in serious deterioration of image quality by the viewing angle, as shown in the actual curve in FIG. 1. Obviously, the big difference between the ideal curve and the actual curve, makes the gray scale, which should have appeared under a larger viewing angle, changes due to serious deterioration. Color shift comes consequently.

In order to improve the color shift of the VA liquid crystal, a general solution is to further divide the sub-pixels into primary pixel and secondary pixel. See FIG. 2, a curve A representing the primary pixel and another curve B representing the secondary pixels b will be formed. Since the primary pixel and secondary pixels will be displayed together, the actual curve will be obtained in FIG. 2. Obviously, the actual curve in FIG. 2 is closer to the ideal curve than the actual curve in FIG. 1. Therefore, if the display panel is viewed from a large viewing angle after dividing the sub-pixel into primary pixel and the secondary pixel, the trend of the brightness change of the pixel will be close to the trend of the voltage change when viewed in a small viewing angle.

However, this way of dividing the primary pixel from the secondary pixels will solve the color shift problem by giving different driving voltages respectively to the primary and secondary pixels in space, thus resulting in need to redesign the metal trace or thin film transistor (TFT) components to drive the secondary pixels when designing the pixel. This will brings about sacrifice of the photic aperture opening and thus affect the panel transmittance.

Therefore, it has to be discussed that the current color shift solution cannot improve the color shift perfectly as the panel transmittance would be influenced.

The previously mentioned content is only used to assist in understanding the technical solution of the present application, and does not admit that the above content is prior art.

SUMMARY

The main purpose of the present application is to provide a driving method, a driving device and a driving device for a display panel, aiming to effectively improve the color shift phenomenon without affecting the panel transmittance.

In order to achieve the aforementioned objectives, the present application provides a driving method of a display panel, which includes a display array including pixel unit defined in an array. The pixel unit includes a first sub-pixel, a second sub-pixel and a third sub-pixel in a first direction, and the first sub-pixel, the second sub-pixel and the third sub-pixel of the pixel unit are respectively aligned in the first direction according to an array order. The driving method of the display panel includes the following steps:

taking two adjacent sub-pixels in a second direction scanned as a data driving period; sequentially driving the two adjacent sub-pixels respectively through the data driving signal in the second direction during the data driving period, when a data driving signal input by a data driving circuit is received; and driving positively a first adjacent sub-pixel of the two adjacent sub-pixels in a first time interval and driving negatively a second adjacent sub-pixel of the two adjacent sub-pixels in a second time interval. The first time interval is different from the second time interval.

Additionally, in order to achieve the aforementioned objective, the present application also provides a driving device for a display panel, the display panel includes a display array. The display array includes a pixel unit arranged in an array. The pixel unit includes a first sub-pixel, a second sub-pixel and a third sub-pixel in a first direction. And the first sub-pixel, the second sub-pixel and the third sub-pixel of the pixel unit are respectively aligned in the first direction according to an array order. The driving device of the display panel includes:

a driving module, configured to take two adjacent sub-pixels in a second direction scanned as a data driving period, and to sequentially drive the two adjacent sub-pixels respectively through the data driving signal in the second direction during the data driving period, when a data driving signal input by a data driving circuit is received. And the driving module is further configured to drive positively a first adjacent sub-pixel of the two adjacent sub-pixels in a first time interval and to drive negatively a second adjacent sub-pixel of the two adjacent sub-pixels in a second time interval. The first time interval is different from the second time interval.

Additionally, in order to achieve the aforementioned objective, the present application also provides a display apparatus, wherein the display apparatus comprises a display panel, a memory, a non-volatile memory, and a processor; the non-volatile memory stores executable instructions, and the processor executes the executable instructions, In the present application, in order to effectively avoid the color shift without redesigning, the metal wiring or TFT components, data driving signals with different positive driving duration and negative driving duration are input in the column direction to drive the pixel unit. Since the positive driving duration and negative driving duration are different, the duration for charging the pixel unit is directly controlled. And when the charging duration is different, the charging capability will be different, forming an alternative alignment of the high-voltage pixel unit and the low-voltage pixel unit, and further improving the color shift. Therefore, it would be discussed that the color shift has been successfully improved in the present application without affecting the transmittance of the panel.

The implementation, functional features and advantages of the purpose of the present application will be further described herein with reference to the accompanying drawings combined with the exemplary embodiments.

DETAILED DESCRIPTION OF THE EMBODIMENTS

It should be understood that the specific embodiments described herein are only for the purpose of explaining the present application and are not intended for limitation.

Figure 1:
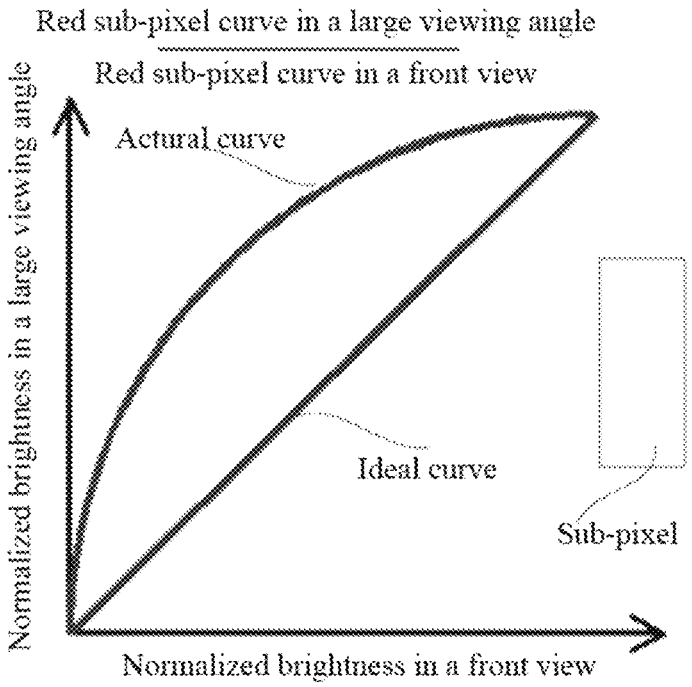
FIG. 1 is a schematic view showing displays at different viewing angles under a single pixel.
Figure 2:
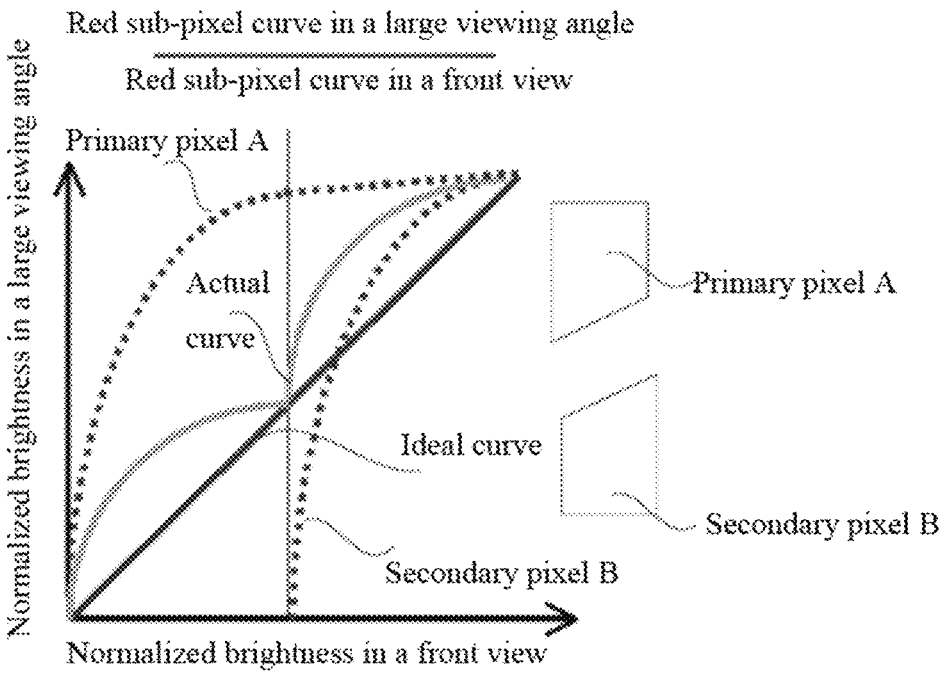
FIG. 2 is a schematic view showing displays at different viewing angles under the primary pixel and the secondary pixel.
Figure 3:
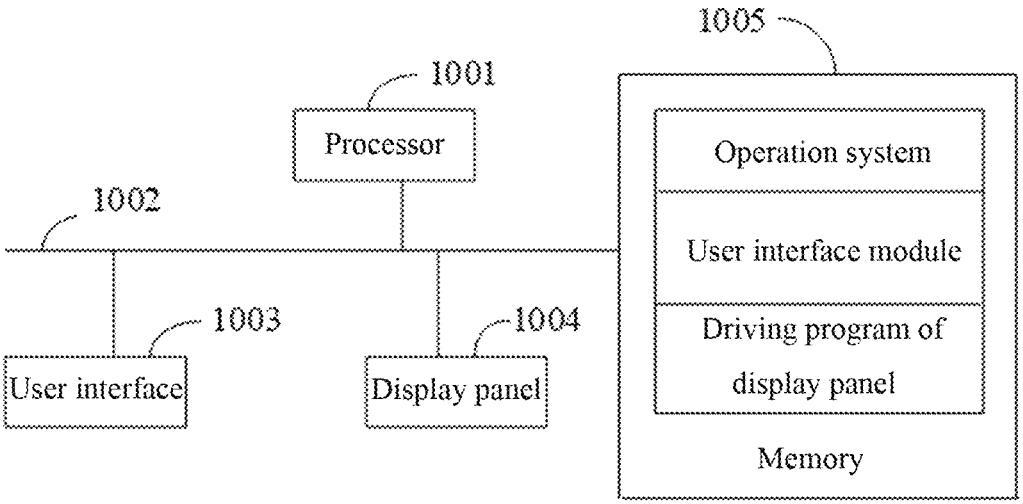
FIG. 3 is a schematic structural diagram of a display device of a hardware operating environment involved in some exemplary embodiments of the present application.

Referring to FIG. 3, FIG. 3 is a schematic structural diagram of a display device of a hardware operating environment involved in some exemplary embodiments of the present application.

As shown in FIG. 3, the display device may include a processor 1001, such as a CPU, a communication bus 1002, a user interface 1003, a display panel 1004, and a memory 1005. The communication bus 1002 is configured to enable connection communication between these components. The user interface 1003 may include a display and an input unit such as a keyboard. The user interface 1003 may optionally include a standard wired interface and a wireless interface. The memory 1005 may be a high-speed RAM memory or a non-volatile memory, such as a magnetic disk memory. The memory 1005 may optionally be a memory device independent from the aforementioned processor 1001.

Those skilled in the art will understand that the display device structure shown in FIG. 3 does not constitute a limitation for the display device, and the display device may include more or less components than shown, or some components may be combined, or different component arrangements may be used.

As shown in FIG. 3, the memory 1005 as a storage medium may include an operating system, a user interface module, and a driver of a display panel.

In the display device shown in FIG. 3, the processor 1001 and the memory 1005 in the display device of the present application may be defined in a data driving integrated circuit that calls the driver of the display panel stored in the memory 1005 through the processor 1001, and execute the instructions of the driving method of the display panel.

Based on the above hardware structure, the display panel 1004 includes a display array which includes pixel units arranged in an array, some exemplary embodiments of the driving method of the display panel of the present application is provided herein.

Figure 4:
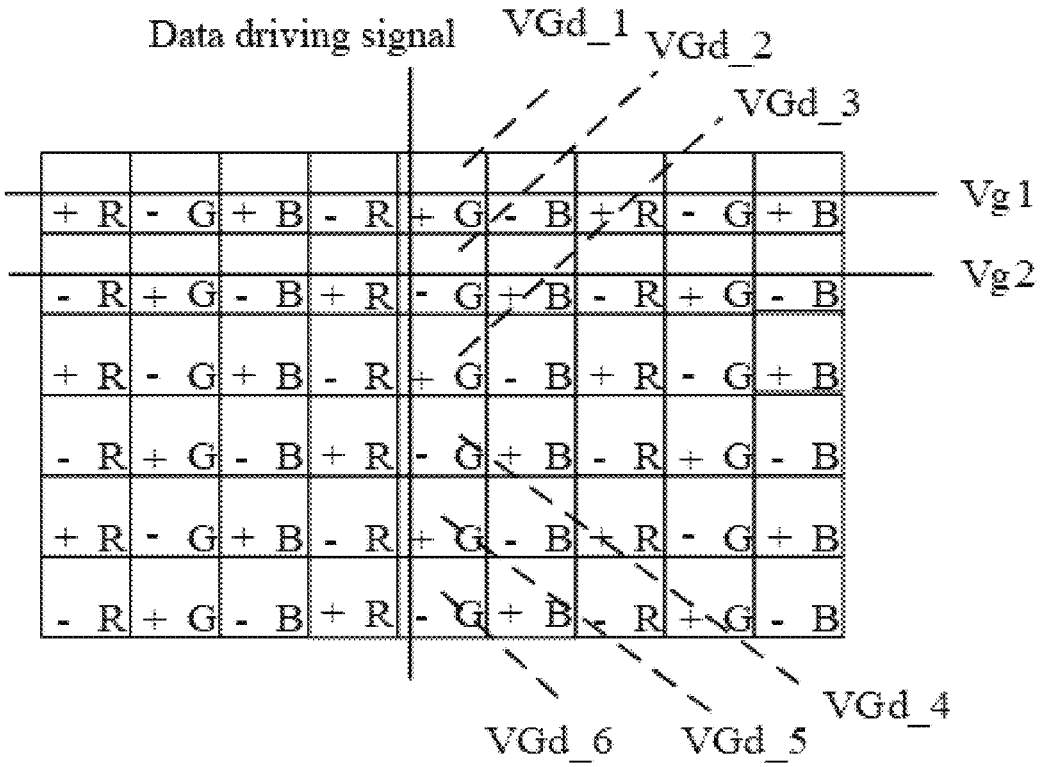
FIG. 4 is a first structural schematic diagram of the display array.
Figure 5:
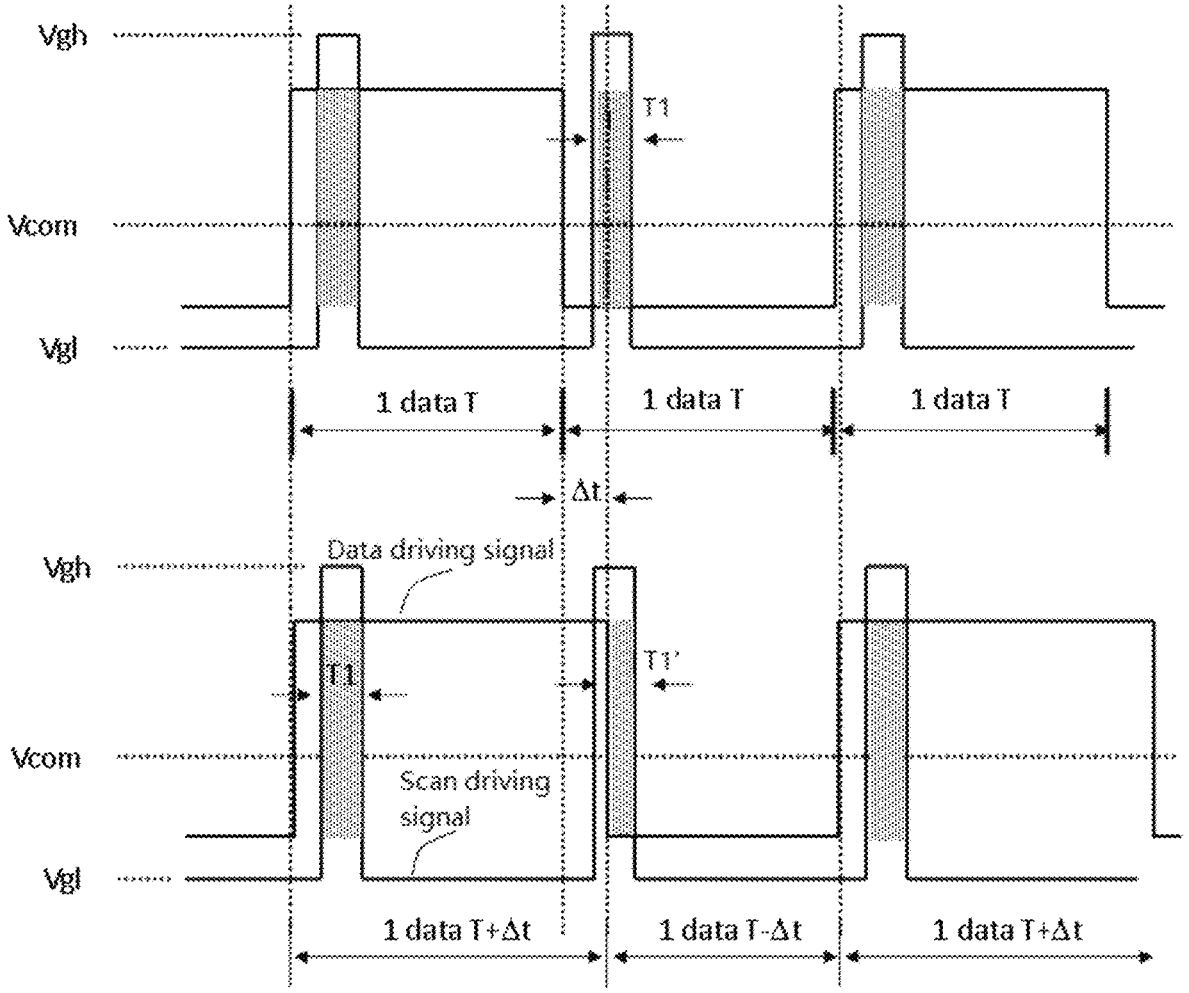
FIG. 5 is a timing schematic diagram of the first driver of the display array.

Referring to FIG. 4 which shows the structure of the display array and FIG. 5 which shows a timing schematic diagram of the driver of the display array in FIG. 4. In order to implement adjacent sub-pixels with high and low voltage alternatively-driving arrangement, point inversion driving is adopted on the same data circuit, directly controlling the interval of duty cycle of the data driving signal of each sub-pixel. The correct charging time is controlled of the scan driving signal relative to the data driving signal, so that the charging ability of the each sub-pixel to implement the same driving voltage is different.

Referring to FIG. 4, the first sub-pixel in the column direction is VGd_1, and the second sub-pixel in the column direction is VGd_2, and the third sub-pixel in the column direction is VGd_3, and the fourth secondary pixels in the column direction is VGd_4, and the fifth secondary pixels in the column direction is VGd_5, and the sixth pixel in the column direction is VGd_6.

In order to control the charging time of the scan driving signal relative to the data driving signal, the data driving time of the positive sub-pixels VGd_1, VGd_3 and VGd_5 is long and the data driving time of the negative sub-pixels VGd_2, VGd_4 and VGd_6 is short. Thus, the equivalent charging voltages of the negative secondary pixels VGd_2, VGd_4 and VGd_6 decreases, forming a so-called low voltage sub-pixel, and the equivalent charging voltages of the positive secondary pixels VGd_1, VGd_3 and VGd_5 maintain the original charging signal to form a so-called high voltage sub-pixel.

A difference in charging between the high-voltage secondary pixels and the low-voltage secondary pixels can be achieved by means of forming a row of secondary pixels interspersed with the long and short data driving durations rather than the same original data driving duration, thereby improving the color shift.

Figure 6:
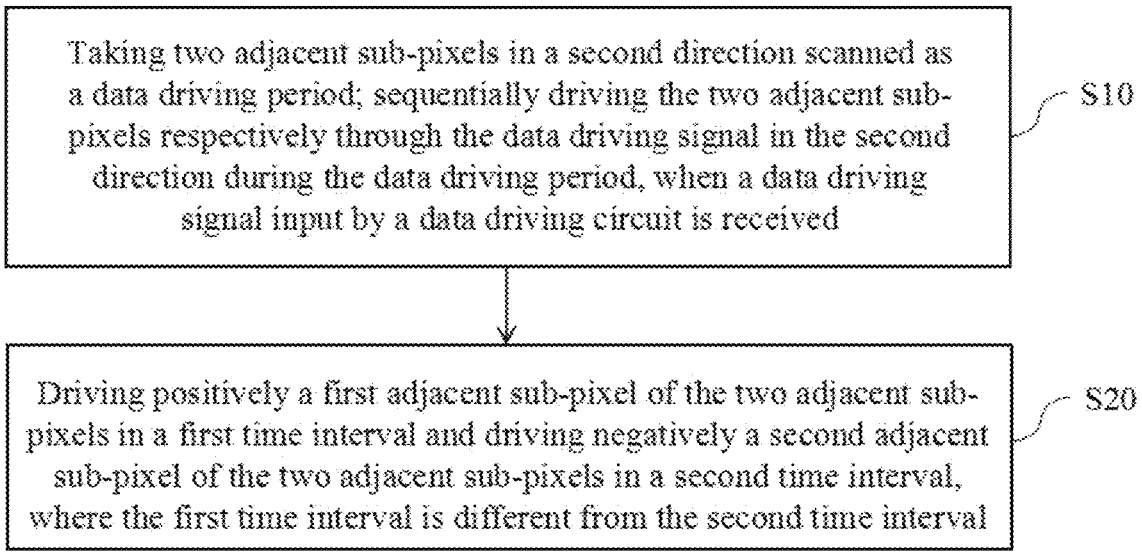
FIG. 6 is a flow chart of the first embodiment of the driving method of the display panel of the present application.

Referring to FIG. 6, which is a flow chart of some exemplary embodiments of the driving method of the display panel of the present application.

The display array can be seen in FIG. 4, and the timing schematic diagram of the driver of the display array can be seen in FIG. 5.

In some exemplary embodiments, the driving method of the display panel includes the following steps:

Step S10: taking two adjacent sub-pixels in a second direction scanned as a data driving period; sequentially driving the two adjacent sub-pixels respectively through the data driving signal in the second direction during the data driving period, when a data driving signal input by a data driving circuit is received.

Specifically, some exemplary embodiments can be implemented based on the display array shown in FIG. 4 and the driving timing shown in FIG. 5. In particular, the upper graph in FIG. 5 is a standard driving timing as a reference for ease of understanding. The lower figure in FIG. 5 shows the data driving signal, scan driving signal and reference voltage input by the data drive circuit in some exemplary embodiments, where Vcom is the reference voltage, Vgh is the maximum value of the scan driving signal, and Vgl is the minimum value of the scan driving signal. The first direction may be a row direction and the second direction may be a column direction.

Step S20: driving positively a first adjacent sub-pixel of the two adjacent sub-pixels in a first time interval and driving negatively a second adjacent sub-pixel of the two adjacent sub-pixels in a second time interval, where the first time interval is different from the second time interval.

It can be understood that, since the scan driving signal is used to control the turning on and off of the pixel unit, and the data driving signal is used to charge the pixel unit. Of course, it is the premise that the scan driving signal has controlled the pixel unit to turn on, to ensure the data driving signal be able charge. Therefore, when the scan driving signal of the sub-pixels in the column direction are the same, the first sub-pixel and the second sub-pixel in the column direction can be given with different charging capabilities by directly controlling the charging time of the pixel unit by the data driving signals.

In some exemplary embodiments, referring to FIG. 4, the first sub-pixel in the column direction may be abbreviated as VGd_1 and the second sub-pixel in the column direction may be abbreviated as VGd_2. Referring to FIG. 5, VGd_1 and VGd_2 are both charged by one data driving signal. So the first preset voltage and the second preset voltage can be provided in the data driving signal which are alternately switched in the data driving period. The first preset voltage is larger than the reference voltage, and is used for positive driving. The second preset voltage is smaller than the reference voltage, and is used for negative driving. And the duration of the first preset voltage is different from the duration of the second preset voltage. For example, the duration of the first preset voltage is longer than the duration of the second preset voltage. Considering that the scan driving signals VG1 and VG2 are the same, the first period of positive driving of VGd_1 by the first preset voltage will be larger than the second period of negative driving of VGd_2 by the second preset voltage. Not only are sub-pixels of different polarities formed, but also the equivalent charging voltages formed by VGd_1 and VGd_2 are different due to the different driving duration. Finally, VGd_1 is formed as a high voltage sub-pixel and VGd_2 is formed as a low voltage sub-pixel. Due to the charging difference between high-voltage sub-pixel and low-voltage secondary pixels, the high-voltage pixel units and the low-voltage pixel units are alternately defined, thereby improving the color shift.

In some exemplary embodiments, in order to effectively avoid the color shift without redesigning metal traces or TFT components, data driving signals with different positive driving duration and negative driving duration are input in the column direction to drive the pixel unit. Since the positive driving duration and negative driving duration are different, the charging duration for the pixel unit is directly controlled. The difference in charging duration, thus makes the charging capability different, forming a high-voltage pixel unit and a low-voltage pixel unit which are arranged alternately, thus improving the color shift. Therefore, it can be considered that some exemplary embodiments successfully improve the color shift without affecting the panel transmittance.

Further, before driving positively a first adjacent sub-pixel of the two adjacent sub-pixels in a first time interval and driving negatively a second adjacent sub-pixel of the two adjacent sub-pixels in a second time interval, the method further includes:

driving a sub-pixel in the second direction by a scan driving signal in a scan driving period, when each scan driving signal input by the scan driving circuit is received, wherein, a duration of the data driving period is equal to the duration of two sequential scan driving period.

In some specific exemplary embodiments, as shown in FIG. 4, each scan driving signal may be the same for driving secondary pixels in the column direction. For example, the scan driving signal Vg1 for driving VGd_1 and the scan driving signal Vg2 for driving VGd_2 may be the same signal, and could be the scan driving signal shown in FIG. 5.

Additionally, a scan driving period can be recorded as 1dataT, so the duration of data-driven period is 2*dataT.

Further, the data driving period includes a first scan driving period and a second scan driving period, and the duration of the first scan driving period is equal to that of the second scan driving period.

After driving a sub-pixel in the second direction by a scan driving signal in a scan driving period, when each scan driving signal input by the scan driving circuit is received, the method further includes:

positively driving the first adjacent sub-pixel by a first preset voltage in a positive driving duration, when the first adjacent sub-pixel is driven by the scan driving signal in the first scan driving period, wherein, the positive driving duration is a duration occupied by the first preset voltage within the data driving period, and the positive driving duration is greater than the first scan driving period; and negatively driving the second adjacent sub-pixel by a second preset voltage in a negative driving duration, when the second adjacent sub-pixel is driven by the scan driving signal in the second scan driving period, wherein, the negative driving duration is a duration occupied by the second preset voltage within the data driving period, the positive driving duration is greater than the negative driving duration, the negative driving duration is less than the second scan driving period and greater than the time difference between the second scan driving period and a scan conducting duration, and the scan conducting duration is a duration when conduction is performed to the sub-pixel in the second direction within the scan driving period.

In some specific exemplary embodiments, as shown in FIG. 5, the duration of the data driving period is 2*dataT, and the duration of the data driving signal can be called the positive driving duration when it is the first preset voltage, and can be recorded as 1dataT+Δt. The duration of the data driving signal can be called the negative driving duration when it is the second preset voltage, and can be recorded as 1dataT−Δt, with the total duration of the positive and negative driving duration being 2*dataT.

In order to facilitate the understanding of the driving principle of data driving signals for sub-pixel, two continuous scan driving period can be expressed, i.e., two continuous dataT durations are taken as an example. If FIG. 5 is referred, the data driving signal is always the first preset voltage when the scan driving signal is in the first dataT.

Since the positive driving duration of the data driving signal is 1dataT+Δt, which is longer than dataT, the scan driving signal completely makes the sub-pixel conductive, and the conductive period can be recorded as T1 and the charging duration is also T1. In the second dataT of the scan driving signal, since the positive driving duration of the data driving signal is 1dataT+Δt. Therefore, during in the second dataT of the scan driving signal, the data driving signal may be the first preset voltage with Δt duration or the second preset voltage with 1dataT−Δt duration.

It should be understood that, it is precisely because of the second dataT of the scan driving signal, the voltage of the data driving signal jumps. Therefore, in the second dataT of the scan driving signal, the voltage jump point of the data driving signal will be included in the pulse width T1 in this time period. So the negative driving duration will be less than T1, which can be recorded as T1'. The first time interval is T1 and the second time interval is T1'.

It can be understood that it is precisely because the driving duration of positive driving is actually T1 and the driving duration of negative driving is actually T1' and T1 is greater than T1', that the charging difference is achieved between the of high-voltage sub-pixels and the of low-voltage sub-pixels. The first sub-pixel with the driving duration of T1 can be regarded as a high-voltage sub-pixel, and the second sub-pixel with the driving duration of T' can be regarded as a low-voltage sub-pixel, thereby achieving improvement in color shift.

Further, each of adjacent sub-pixels in the pixel unit is alternately arranged with high and low voltages.

In some exemplary embodiments, polarity inversion can be performed based on dot inversion. For example, referring to FIG. 4, in which VGd_1 is positive driven, and the left and right adjacent sub-pixels in the line direction where VGd_1 is located are negative driven. VGd_2 is negative driven, and the left and right adjacent sub-pixels in the line direction where VGd_2 is located are positive driven.

Further, the first sub-pixel, the second sub-pixel and the third sub-pixel may respectively be a red sub-pixel, a green sub-pixel and a blue sub-pixel.

In some exemplary embodiments, referring to FIG. 4, in which the pixel units is composed of three color primary pixels, such as red secondary pixels indicated by R, green secondary pixels indicated by G, and blue secondary pixels indicated by B.

Further, after taking two adjacent sub-pixels in a second direction scanned as a data driving period; sequentially driving the two adjacent sub-pixels respectively through the data driving signal in the second direction during the data driving period, when a data driving signal input by a data driving circuit is received, the method further includes:

negatively driving the first adjacent sub-pixel in a third time interval and positively driving the second adjacent sub-pixel in a fourth time interval, when the first adjacent sub-pixel and the second adjacent sub-pixel in the data driving period are sequentially conducted, where the third time interval is the same as the second time interval, and the fourth time interval is the same as the first time interval.

Figure 7:
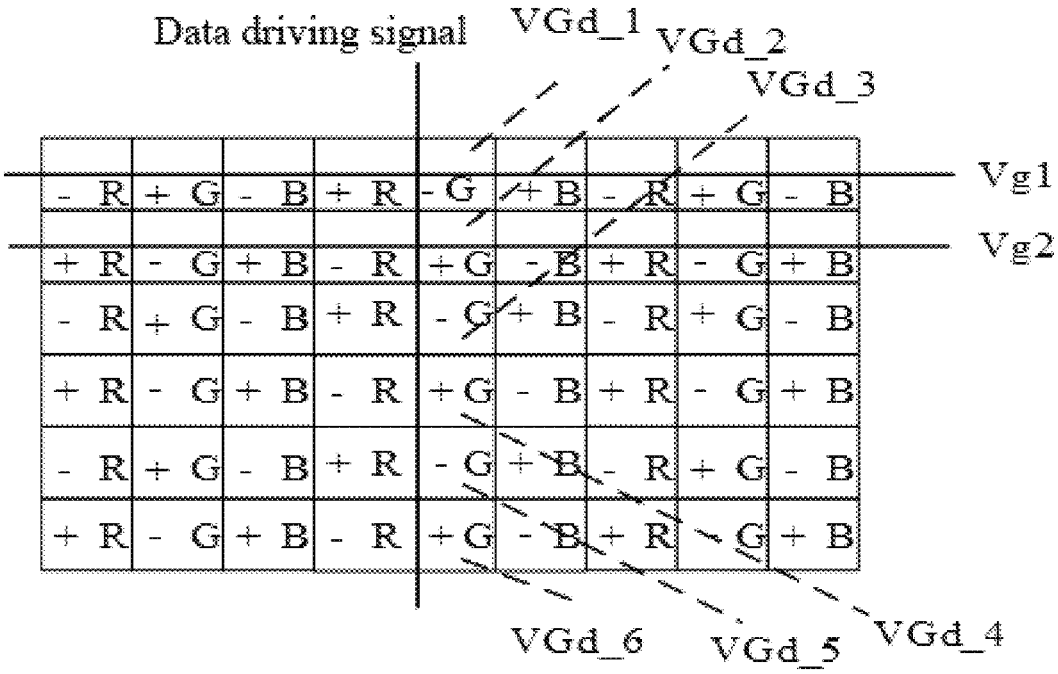
FIG. 7 is a second structural schematic diagram of the display array.
Figure 8:
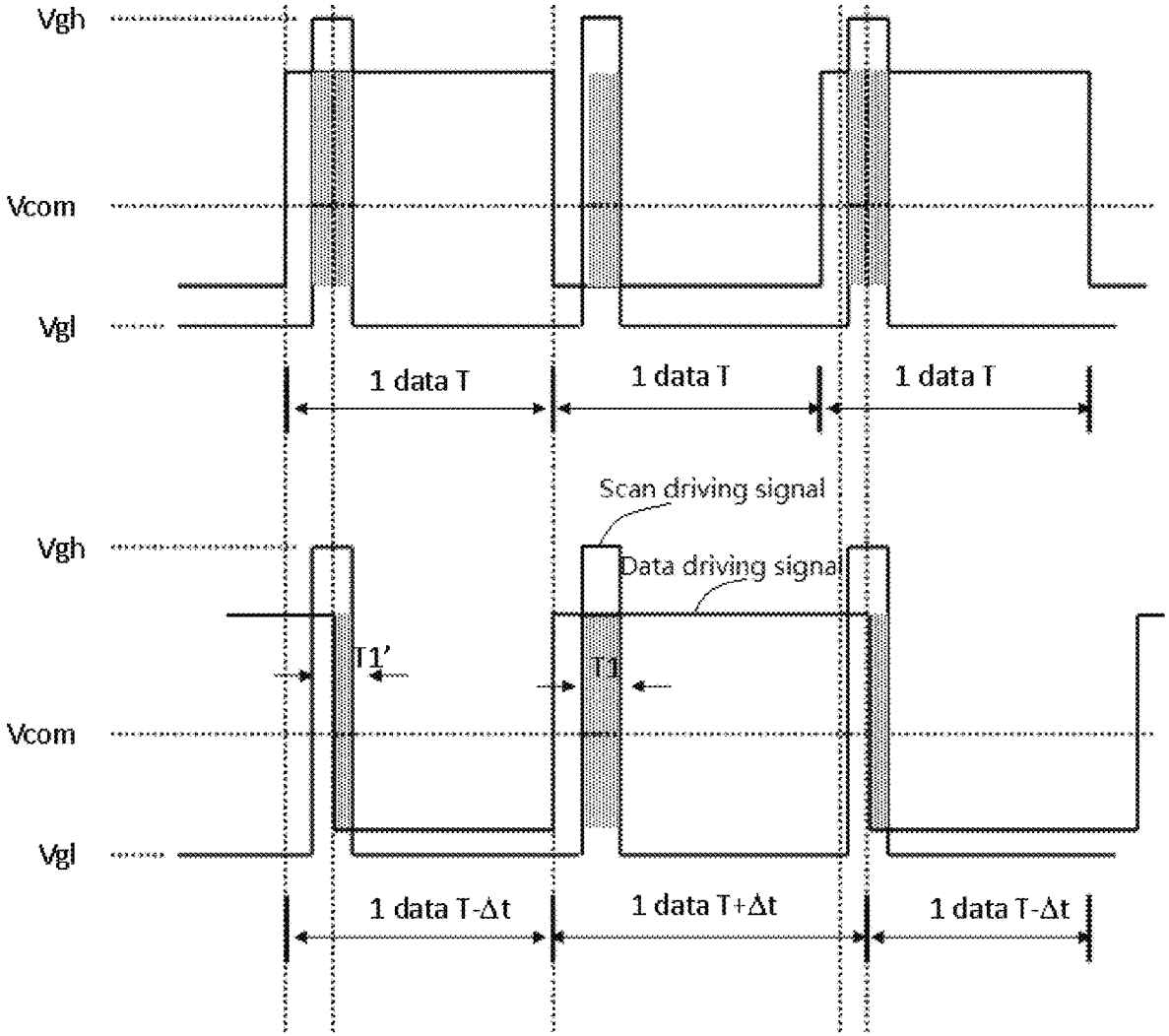
FIG. 8 is a timing schematic diagram of the second driver of the display array.

In some exemplary embodiments, in addition to FIGS. 4 and 5, reference may also be made to FIG. 7 for the structure of the display array of some exemplary embodiments and to FIG. 8 for timing schematic diagram of the second driver of the display array in FIG. 7. Unlike the display array shown in FIG. 4, in which the first preset voltage can drive VGd_1, VGd_3, and VGd_5, and the second preset voltage can drive VGd_2, VGd_4, and VGd_6, as the first preset voltage and the second preset voltage coexist in the data driving signal. Accordingly, as shown in FIG. 7, the first preset voltage may also drive VGd_2, VGd_4, and VGd_6, and the second preset voltage may also drive VGd_1, VGd_3, and VGd_5.

It can be understood that the sub-pixels in the column direction are sequentially negative sub-pixels VGd_1, positive sub-pixels VGd_2, negative sub-pixels VGd_3, positive sub-pixels VGd_4, negative sub-pixels VGd_5, and positive sub-pixels VGd_6. The data driving timing of the corresponding secondary pixels is T−Δt, T+Δt, T−Δt, T+Δt, T−Δt, and T+Δt, making the data driving signals of each sub-pixels relative to the gate switch charging duration being T1', T1, T1', T1, T1', and T1. In such way, sub-pixels with different frame timing and different high and low voltage signals can be implemented, and the difference between high voltage sub-pixels and low voltage sub-pixels will not be visible for the naked eye, and there will be no defect of resolution reduction.

Figure 9:
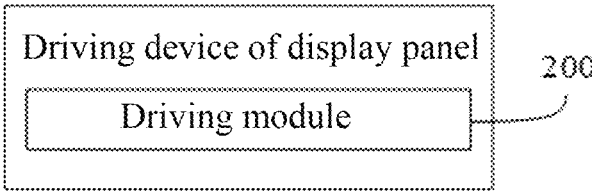
FIG. 9 is a schematic structural diagram of some exemplary embodiments of a driving device for a display panel of the present application.

Additionally, the embodiment of the present application also provides a driving device for the display panel. As shown in FIG. 9, the display panel includes a display array which includes pixel units arranged in an array. The pixel units include a first sub-pixel, a second sub-pixel and a third sub-pixel in a first direction, and the three sub-pixels of the pixel units are respectively aligned in the first direction according to the arrangement order. The driving device of the display panel includes:

a driving module 200, configured to take two adjacent sub-pixels in a second direction scanned as a data driving period, and to sequentially drive the two adjacent sub-pixels respectively through the data driving signal in the second direction during the data driving period, when a data driving signal input by a data driving circuit is received. And the driving module 200 is further configured to drive positively a first adjacent sub-pixel of the two adjacent sub-pixels in a first time interval and to drive negatively a second adjacent sub-pixel of the two adjacent sub-pixels in a second time interval, where the first time interval is different from the second time interval.

Figure 10:
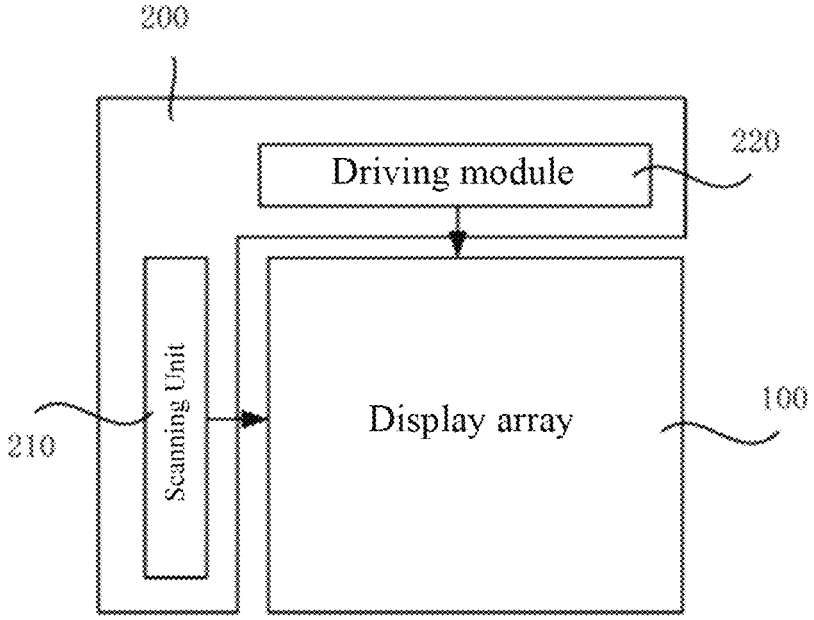
FIG. 10 is a structural diagram of some other embodiment of the driving device of the display panel of the present application.

As shown in FIG. 10, the driving device of the display panel also includes a display array 100 and a driving module 200. The driving module 200 may include a scanning unit 210 and a driving unit 220. The scanning unit 210 is configured to output scan driving signals, typically scanning pixel units line by line, and the driving unit 220 outputs data driving signals so that pixel units receive driving data for display when scanned.

The driving module 200 can refer to the aforementioned exemplary embodiments. After processing, data driving signals with different positive driving duration and negative driving duration are input in the second direction to drive the pixel unit. Since the positive driving duration and the negative driving duration are different, the charging duration for the pixel unit will be directly controlled, and the charging capability will be different, thus forming a high-voltage pixel unit and a low-voltage pixel unit arranged alternately, thus further improving the color shift. Therefore, it can be considered that the color shift has been successfully improved without affecting the transmittance of the panel.

In addition, the exemplary embodiment of the present application also provides a storage medium on which the driver of the display panel is stored, and the driver of the display panel is executed by the processor to perform the steps of the driving method of the display panel as described above.

It should be noted that in this document, the terms "comprise" "include" or any other variation thereof, are intended to cover a non-exclusive inclusion, such that a process, method, article, or system that includes a series of components includes not only those components but also other components not expressly listed, or components inherent to such process, method, article, or system. Without further limitation, the element defined by the statement "include one" does not exclude the existence of another identical element in the process, method, article or system that includes the element.

The aforementioned serial numbers of the exemplary embodiments of the present application are for the purpose of description only and do not represent the superiority or inferiority of the exemplary embodiments.

From the description of the above exemplary embodiments, it will be clear to those skilled in the art that the method of the aforementioned exemplary embodiments can be implemented by means of software plus necessary general-purpose hardware platform, although it can also be implemented by hardware, but in many cases the former is a better exemplary embodiment. Based on this understanding, the technical solution of the present application, in nature or part of the contribution to the prior art, can be embodied in the form of a software product stored in a storage medium (such as ROM/RAM, diskette, CD and etc.) as described above, including several instructions to cause a terminal device (which can be a mobile phone, a computer, a server, an air conditioner, or a network device, etc.) to perform the methods described in various exemplary embodiments of the present application.

The above is only the preferred exemplary embodiments of the present application, and is not therefore limiting the scope of the present application. Any equivalent structure or equivalent process transformation made by using the contents of the specification and drawings of the present application, or directly or indirectly applied in other related technical fields, shall be included in the protection scope of the present application.

What is claimed is:

1. A driving method of a display panel, wherein, the display panel comprises a display array, the display array comprises a pixel unit arranged in an array, the pixel unit comprises a first sub-pixel, a second sub-pixel and a third sub-pixel in a first direction, and the first sub-pixel, the second sub-pixel and the third sub-pixel of the pixel unit are respectively aligned in the first direction according to an array order; the driving method of the display panel comprises following steps:

scanning two adjacent sub-pixels in a second direction during a data driving period; sequentially driving the two adjacent sub-pixels respectively with a data driving signal in the second direction during the data driving period, when the data driving signal which is inputted by a data driving circuit is received;

driving a sub-pixel in the second direction by a scan driving signal in a scan driving period, when the scan driving signal which is inputted by a scan driving circuit is received, wherein, a duration of the data driving period is equal to a duration of two sequential scan driving period;

driving positively a first adjacent sub-pixel of the two adjacent sub-pixels in a first time interval and driving negatively a second adjacent sub-pixel of the two adjacent sub-pixels in a second time interval, wherein, the first time interval is different from the second time interval, wherein:

the data driving period comprises a first scan driving period and a second scan driving period, and a duration of the first scan driving period is equal to a duration of the second scan driving period;

after driving the sub-pixel in the second direction by the scan driving signal in the scan driving period, when the scan driving signal which is inputted by the scan driving circuit is received, the method further comprises:

positively driving the first adjacent sub-pixel by a first preset voltage in a positive driving duration, when the first adjacent sub-pixel is driven by the scan driving signal in the first scan driving period, wherein, the positive driving duration is a duration occupied by the first preset voltage within the data driving period, and the positive driving duration is greater than the first scan driving period; and negatively driving the second adjacent sub-pixel by a second preset voltage in a negative driving duration, when the second adjacent sub-pixel is driven by the scan driving signal in the second scan driving period, wherein, the negative driving duration is a duration occupied by the second preset voltage within the data driving period, the positive driving duration is greater than the negative driving duration, and the negative driving duration is less than the second scan driving period and greater than a time difference between the second scan driving period and a scan conducting duration, wherein the scan conducting duration is a duration when conduction is performed to the sub-pixel in the second direction within the scan driving period.

2. The method of claim 1, wherein, after scanning the two adjacent sub-pixels in the second direction during the data driving period; sequentially driving the two adjacent sub-pixels respectively with the data driving signal in the second direction during the data driving period, when the data driving signal which is inputted by the data driving circuit is received, the method further comprises:

negatively driving the first adjacent sub-pixel in a third time interval and positively driving the second adjacent sub-pixel in a fourth time interval, when the first adjacent sub-pixel and the second adjacent sub-pixel in the data driving period are sequentially conducted, wherein, the third time interval is equal to the second time interval, and the fourth time interval is equal to the first time interval.

3. The method of claim 1, wherein, each adjacent sub-pixels in the pixel unit are alternately provided with high and low voltages.

4. The method of claim 1, wherein the first sub-pixel, the second sub-pixel and the third sub-pixel respectively correspond to a red sub-pixel, a green secondary pixel and a blue sub-pixel.

5. A driving device of a display panel, wherein, the display panel comprises a display array, the display array comprises a pixel unit arranged in an array, the pixel unit comprise a first sub-pixel, a second sub-pixel and a third sub-pixel in a first direction, and the first sub-pixel, the second sub-pixel and the third sub-pixel of the pixel unit are respectively aligned in the first direction according to an array order; the driving device of the display panel comprises:

a driving module, configured to scan two adjacent sub-pixels in a second direction during a data driving period, and to sequentially drive the two adjacent sub-pixels respectively with a data driving signal in the second direction during the data driving period, when the data driving signal which is inputted by a data driving circuit is received, wherein:

a sub-pixel in the second direction is driven by a scan driving signal in a scan driving period, when the scan driving signal which is inputted by the scan driving circuit is received, wherein, a duration of the data driving period is equal to a duration of two sequential scan driving period; and the driving module is further configured to drive positively a first adjacent sub-pixel of the two adjacent sub-pixels in a first time interval and to drive negatively a second adjacent sub-pixel of the two adjacent sub-pixels in a second time interval, wherein, the first time interval is different from the second time interval, wherein:

the data driving period comprises a first scan driving period and a second scan driving period, and a duration of the first scan driving period is equal to a duration of the second scan driving period;

the first adjacent sub-pixel is positively driven by a first preset voltage in a positive driving duration, when the first adjacent sub-pixel is driven by the scan driving signal in the first scan driving period, the positive driving duration is a duration occupied by the first preset voltage within the data driving period, and the positive driving duration is greater than the first scan driving period; and the second adjacent sub-pixel is negatively driven by a second preset voltage in a negative driving duration, when the second adjacent sub-pixel is driven by the scan driving signal in the second scan driving period, the negative driving duration is a duration occupied by the second preset voltage within the data driving period, the positive driving duration is greater than the negative driving duration, the negative driving duration is less than the second scan driving period and greater than a time difference between the second scan driving period and a scan conducting duration, wherein the scan conducting duration is a duration when conduction is performed to the sub-pixel in the second direction within the scan driving period.

6. A display apparatus, wherein the display apparatus comprises a display panel, a memory, a non-volatile memory, and a processor; the non-volatile memory stores executable instructions, and the processor executes the executable instructions, causing the display apparatus to perform:

scanning two adjacent sub-pixels in a second direction during a data driving period; sequentially driving the two adjacent sub-pixels respectively with a data driving signal in the second direction during the data driving period, when the data driving signal which is inputted by a data driving circuit is received, wherein:

a sub-pixel in the second direction is driven by a scan driving signal in a scan driving period, when the scan driving signal which is inputted by a scan driving circuit is received, wherein, a duration of the data driving period is equal to a duration of two sequential scan driving period; and driving positively a first adjacent sub-pixel of the two adjacent sub-pixels in a first time interval and driving negatively a second adjacent sub-pixel of the two adjacent sub-pixels in a second time interval, wherein, the first time interval is different from the second time interval, wherein:

the data driving period comprises a first scan driving period and a second scan driving period, and a duration of the first scan driving period is equal to a duration of the second scan driving period;

the first adjacent sub-pixel is positively driven by a first preset voltage in a positive driving duration, when the first adjacent sub-pixel is driven by the scan driving signal in the first scan driving period, wherein, the positive driving duration is a duration occupied by the first preset voltage within the data driving period, and the positive driving duration is greater than the first scan driving period; and the second adjacent sub-pixel is negatively driven by a second preset voltage in a negative driving duration, when the second adjacent sub-pixel is driven by the scan driving signal in the second scan driving period, wherein, the negative driving duration is a duration occupied by the second preset voltage within the data driving period, the positive driving duration is greater than the negative driving duration, the negative driving duration is less than the second scan driving period and greater than a time difference between the second scan driving period and a scan conducting duration, and the scan conducting duration is a duration when conduction is performed to the sub-pixel in the second direction within the scan driving period.

7. The display apparatus of claim 6, wherein, the first adjacent sub-pixel is negatively driven in a third time interval and the second adjacent sub-pixel is positively driven in a fourth time interval, when the first adjacent sub-pixel and the second adjacent sub-pixel in the data driving period are sequentially conducted, wherein, the third time interval is equal to the second time interval, and the fourth time interval is equal to the first time interval.

8. The display apparatus of claim 6, wherein, each adjacent sub-pixels in the pixel unit are alternately provided with high and low voltages.

9. The display apparatus of claim 6, wherein, the first sub-pixel, the second sub-pixel and the third sub-pixel are a red sub-pixel, a green sub-pixel, and a blue sub-pixel, respectively.

* * * * *